United States Patent [19]

Korsch

[11] 4,097,303

[45] Jun. 27, 1978

[54] BATCH-TYPE CENTRIFUGE

[75] Inventor: Helmut Korsch, Cremlingen-Weddel, Germany

[73] Assignee: Braunschweigische Maschinenbauanstalt, Braunschweig, Germany

[21] Appl. No.: 755,331

[22] Filed: Dec. 29, 1976

[30] Foreign Application Priority Data

Jan. 23, 1976 Germany ..... 7601807[U]

[51] Int. Cl.[2] ..... B04B 15/00

[52] U.S. Cl. ..... 127/19; 233/46

[58] Field of Search ..... 233/1 R, 1 A, 1 B, 46, 233/47 R; 210/380 L, 378, 379, 381, 382; 127/19, 56

[56] References Cited

U.S. PATENT DOCUMENTS

| | | | |
|---|---|---|---|
| 2,973,288 | 2/1961 | Riedel | 127/56 X |
| 3,207,627 | 9/1965 | Dietzel et al. | 127/56 X |
| 3,246,837 | 4/1966 | Douglas | 233/47 R |
| 3,655,124 | 4/1972 | Sommer | 233/46 |

*Primary Examiner*—George H. Krizmanich
*Attorney, Agent, or Firm*—W. G. Fasse; W. W. Roberts

[57] ABSTRACT

A centrifuge has a rotatable basket with a vertical axis of rotation and mounted within a housing. In order to prevent liquid moving along the inner walls of the housing from dropping into the basket, an elastic ring is coaxially mounted above the upper flange of the basket, and sealed with respect to the inside of the housing.

6 Claims, 3 Drawing Figures

BATCH-TYPE CENTRIFUGE

BACKGROUND OF THE INVENTION

The invention relates to a batch-type centrifuge, in particular, a sugar centrifuge.

The curing basket of sugar centrifuges generally comprises a cylindrical shell with liquid drain holes, as well as of end flanges directed radially inwardly toward the vertically running axis of rotation of the basket and arranged at the ends of the cylindrical shell. The curing basket of these centrifuges is arranged inside a housing serving as collecting space for the liquid phase of the curing product so that during the curing operation the liquid is drained through the liquid drain holes by centrifugal action.

In the operation of centrifuges, in particular sugar centrifuges of the type described above, it has been observed that liquid run-off, i.e., syrup flows up the inner cylindrical surface of the housing against the force of gravity - probably due to the action of the high air turbulences prevailing in the inside of the centrifugal housing —, and thence moves radially to the center on the upper housing part or cover, and finally drops off into the more or less cured sugar inside the basket, thereby contaminating or reducing the quality of the sugar.

OBJECT OF THE INVENTION

It is the object of the present invention to provide means for overcoming this disadvantage of known centrifuges.

SUMMARY OF THE INVENTION

According to the invention, this object is achieved in a batch-type centrifuge described above by attaching a cylindrical ring of an elastic non-rigid or flexible material to the housing, coaxially to the axis of rotation of the basket. The lower edge of the ring is spaced a small distance from the upper end flange of the basket. In addition, a closed annular web is attached tightly to the internal surface of the housing, in order to mount the ring inside the housing.

In one arrangement in accordance with the invention, the web is an annular cylinder, and is fastened to the bottom side of the upper housing part.

As an alternative, the web may be a planar ring affixed to the internal surface of the cylindrical shell of the housing. In this arrangement the web is provided with several bars directed radially to the axis of rotation of the basket and serving as supports for the cylindrical ring.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS

Figure 1:
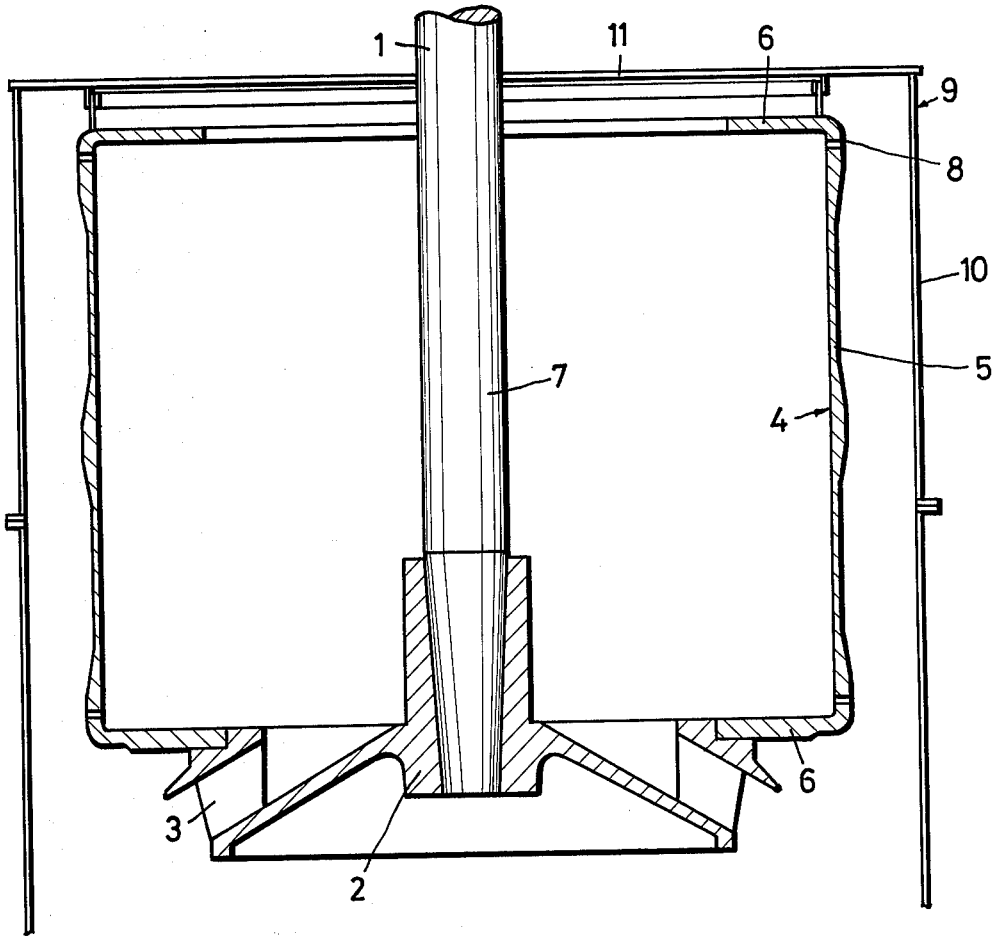
FIG. 1 is a schematic sectional view of a batch-type sugar centrifuge in accordance with the invention.

As an example of the practical embodiment of the basic concept of the invention, the drawings are schematic sectional views of the essential part of a batch-type sugar centrifuge to which the invention particularly relates. A so-called pendulum centrifuge is provided having a centrifuge spindle 1. A curing basket 4 is fixed on the spindle 1 by means of a hub spider 2 fastened to the lower end of the spindle. The hub spider is provided with sugar discharge openings 3. The curing basket 4 comprises mainly a cylindrical shell 5 and two flanges 6 affixed to the opposite ends of the cylindrical shell 5 and thence extending radially inward toward the axis of rotation 7 of the basket. The cylindrical shell 5 is provided with liquid drain openings 8 through which the liquid phase separated from the curing product during the curing process passes.

The curing basket 4 is located inside a housing 9 having a cylindrical shell 10 and an upper housing part 11 (housing cover).

Experience has shown that the separated liquid flows along the internal surface of the cylindrical shell 10. Thence radially inwardly along the bottom surface of the upper part 11, and finally drops into the inside of the curing basket 4 where it contaminates the sugar or other curing product already cured. The invention provides a seal for preventing such contamination.

Figure 2:
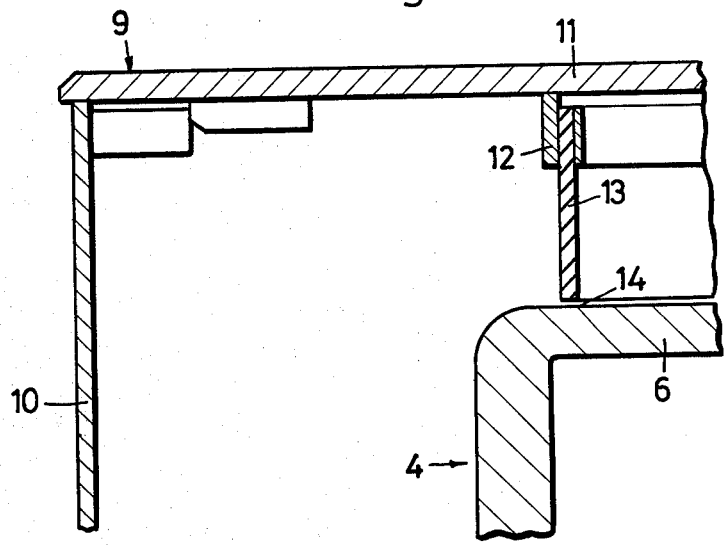
FIG. 2 is a sectional view, on an enlarged scale, a portion of the centrifuge of FIG. 1.

In the design shown in FIG. 2, a web 12 is tightly fixed by conventional means to the upper housing part 11. A cylindrical ring 13 of an elastic material such as rubber or of a flexible material, which is arranged coaxially to the axis of rotation 7 of the basket, is suspended from this web to such an extent that between its lower edge and the upper flange 6 of the curing basket 4 there is only a very small gap 14. At its upper edge, the cylindrical ring 13 is tightly fixed to the web 12 so that a liquid barrier is formed. Liquid ascending from the housing and moving radially to the center along the upper housing part 11 is caught by the web 12, led downwards and finally drained off by the elastic cylindrical ring 13 onto the curing basket 4. From the curing basket 4 this liquid is tossed radially outwardly back to the inside of the housing under the action of the centrifugal force.

Figure 3:
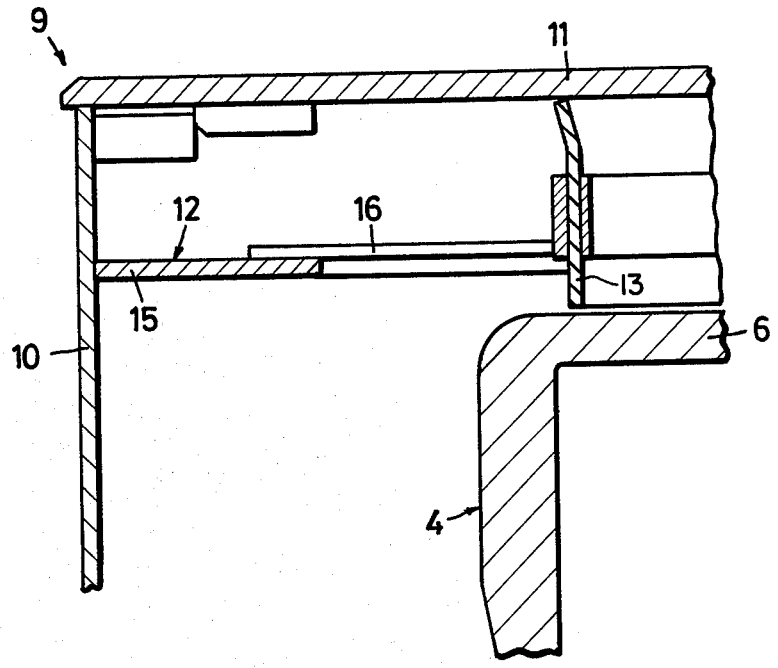
FIG. 3 is a sectional view, corresponding to FIG. 2 of a modification of the invention.

In the alternative design shown in FIG. 3, the web 12 is designed as a planar 15 and is fixed to the cylindrical shell 10 of the housing 9. Several webs 16 running or directed radially inwardly toward the axis of rotation of the basket serve to hold the elastic cylindrical ring 13, so that the upper edge of the ring rests against the upper housing part 11 as a seal. The largest portion of the liquid is stopped by the web 15, and any residues are caught and drained by the elastic cylindrical ring 13.

The function of the seal provided, according to the invention, in the inside of the batch-type centrifuges, is that, owing to its tight fastening in the housing, the web is an obstacle to the liquid film flowing along the internal surface of the housing. If the web is located at the upper housing part or cover, as shown in FIG. 1, the liquid film flows downwardly along the web, reaches the elastic cylindrical ring, and thence drops onto the outside surface of the upper flange of the curing basket, and is tossed back with the force of gravity into the inside of the housing, thus being prevented from penetrating into the inside of the basket. If the annular web is plannar and is located on the cylindrical wall of the housing, as shown in FIG. 3, the liquid film is even not apt to reach the housing cover area. If, however, a certain amount of residual liquid still reaches the housing cover, it is stopped since the upper end of the elastic cylindrical ring rests against the housing cover. The film is thereby drained off in the manner described above, and recycled to the liquid collecting space of the housing.

The elastic or flexible nature of the cylindrical ring serves to avoid damages to the centrifuge if the curing basket is subject to abnormal oscillating movements due to balance errors. If under such circumstances there is, by way of exception, a contact between the rotating curing basket and the elastic ring, the latter will be deformed and possibly the lower edge will be subject to a certain wear, but the basket itself will not be damaged.

Although the invention has been described with reference to specific example embodiemnts, it is to be understood that it is intended to cover all modifications and equivalents within the scope of the appended claims.

What is claimed is:

1. A periodically operating batch type centrifuge comprising a centrifugal basket having a cylindrical shell with liquid drain holes and a vertical axis of revolution, said basket further comprising upper and lower end flanges directed radially inwardly toward the axis of rotation of the basket, said upper end flange defining a central filling opening and sugar discharge means surrounded by said lower end flange, housing means in which the centrifugal basket is mounted for rotation, said housing means serving as a collecting space for receiving liquids drained through the liquid drain holes by centrifugal forces when the basket is rotated, said housing means having a wall with an inner surface facing said upper flange, said centrifuge further comprising a cylindrical ring of an elastic, non-rigid material, and means fixedly mounting said cylindrical, elastic ring coaxially of said basket above said upper end flange with the lower end of said cylindrical, elastic ring spaced a small distance from said upper end flange and radially outwardly of said central filling opening, said mounting means comprising annular means securing said cylindrical, elastic ring in such a position to divert any liquid travelling radially inwardly on said inner surface of said wall and to direct such liquid radially outwardly along said upper end flange.

2. The centrifuge of claim 1, wherein said securing means comprises a closed annular web affixed to the inner surface of said housing.

3. The centrifuge of claim 2, wherein said web comprises a cylindrical web sealingly affixed to said inner wall of said housing, coaxial with said axis of revolution, the upper end of said ring being affixed to said web.

4. The centrifuge of claim 2, wherein said web comprises two coaxial annular members forming a ring gap therebetween extending axially inwardly from said housing, said cylindrical, elastic ring being held in said ring gap.

5. The centrifuge of claim 1, wherein said mounting means further comprises bar means extending radially inwardly from said securing means, said bar means comprising means for holding said cylindrical, elastic ring with its upper end sealingly engaging said wall of said housing.

6. The centrifuge of claim 2, wherein said web is a rigid cylindrical ring.

* * * * *